US009962314B2

(12) United States Patent
Maurette

(10) Patent No.: US 9,962,314 B2
(45) Date of Patent: May 8, 2018

(54) SEXUAL AID METHOD AND APPLIANCE WITH PASSAGEWAY FOR INTIMATE MASSAGE

(76) Inventor: Neil L. Maurette, Calgary (CA)

( * ) Notice: Subject to any disclaimer, the term of this patent is extended or adjusted under 35 U.S.C. 154(b) by 335 days.

(21) Appl. No.: 14/115,356

(22) PCT Filed: Jan. 13, 2012

(86) PCT No.: PCT/CA2012/050026

§ 371 (c)(1),
(2), (4) Date: Nov. 4, 2013

(87) PCT Pub. No.: WO2012/149647

PCT Pub. Date: Nov. 8, 2012

(65) Prior Publication Data

US 2014/0088352 A1 Mar. 27, 2014

(30) Foreign Application Priority Data

May 5, 2011 (CA) ..... 2739533

(51) Int. Cl.
*A61H 19/00* (2006.01)
*A61H 11/00* (2006.01)
(Continued)

(52) U.S. Cl.
CPC ..... *A61H 19/30* (2013.01); *A61H 19/32* (2013.01); *A41C 3/005* (2013.01); *A61H 11/00* (2013.01);
(Continued)

(58) Field of Classification Search
CPC ..... A61F 5/00; A61F 5/41; A61F 2005/411; A61H 19/50; A61H 19/32; A61H 19/30
See application file for complete search history.

(56) References Cited

U.S. PATENT DOCUMENTS 407,341 A 3/1889 Ferris
4,022,196 A * 5/1977 Clinton ..... A61F 5/41 600/39
(Continued)

FOREIGN PATENT DOCUMENTS

CN 201798010 U 4/2011
CN 201860771 U 6/2011

OTHER PUBLICATIONS

"Breast Chronicles: Breasts and Sex", made public Mar. 24, 2010 (Mar. 24, 2010), date per Google "Wayback Machine" reference, <URL: Http://www.breastchronicles.co.uk/zine/breastsexb.shtml>.

*Primary Examiner* — Christine H Matthews

(57) ABSTRACT

The Sexual Aid Method and Appliance with Passageway for Intimate Massage enables individuals and/or couples to enjoy the vast array of health benefits of breast massage. This enables a penis to travel in a defined path over or in between breasts to massage the penis, breast tissue and/or the area in between the breasts. The movement of the penis within the defined path induces flexing of the appliance that further massages the surrounding breast tissue. At least one sternum passageway, tube passageway, breast passageway or passageway enhancer guides the penis. This versatile, economical, non-surgical, green-technology appliance creates at least one passageway that is independent of body contours to allow individuals to experience breast tissue massage, massage of the area in between the breasts and/or hands-free mammary coitus.

19 Claims, 8 Drawing Sheets

(51) Int. Cl.
*A61H 23/02* (2006.01)
*A41C 3/00* (2006.01)

(52) U.S. Cl.
CPC ..... *A61H 23/02* (2013.01); *A61H 2201/0207* (2013.01); *A61H 2201/1261* (2013.01); *A61H 2201/165* (2013.01); *A61H 2201/1619* (2013.01); *A61H 2201/1645* (2013.01); *A61H 2201/1692* (2013.01); *A61H 2205/082* (2013.01)

(56) References Cited

U.S. PATENT DOCUMENTS

| | | | | |
|---|---|---|---|---|
| 5,522,892 | A | 6/1996 | Lin | |
| 5,800,245 | A | 9/1998 | Barbe-Vicuna et al. | |
| 5,807,160 | A | 9/1998 | Wehmeyer | |
| 6,015,331 | A | 1/2000 | Ioakim | |
| 6,769,955 | B1 | 8/2004 | Fisher | |
| 7,192,409 | B2 | 3/2007 | Lorenzo | |
| D626,656 | S | 11/2010 | Jarry | |
| 2003/0199734 | A1* | 10/2003 | Anderson | A61F 5/41 600/38 |
| 2008/0254711 | A1* | 10/2008 | Vickery | A61H 19/00 446/268 |
| 2009/0221942 | A1 | 9/2009 | Shian | |
| 2010/0159801 | A1 | 6/2010 | Abbaszadeh | |
| 2010/0159802 | A1* | 6/2010 | Abbaszadeh | A41C 3/04 450/36 |

* cited by examiner

SEXUAL AID METHOD AND APPLIANCE WITH PASSAGEWAY FOR INTIMATE MASSAGE

BACKGROUND

Field

This application relates generally to breast health, particularly to appliances used by individuals or couples to engage in massage of breast tissue and/or massage of the area in between the breasts.

Prior Art

There is little prior art that pertains to appliances used by individuals or couples to engage in massaging of breast tissue or massaging of the area in between the breasts using an artificial or real penis. The following prior art demonstrates the state of the art that is closest to the sexual aid method and appliance with passageway for intimate massage.

U.S. Pat. No. 407,341, issued Jul. 23, 1889 to Ferris, ABDOMINAL SUPPORTER, illustrates a breast and abdominal bandage. The breast bandage relieves the user of lacteal fluid and absorbs the fluid. It has cutouts for the nipples. The nipple strip and the liquid-absorbing material on the inner side of the cover are designed for liquid absorption. This breast and abdominal bandage does not provide a built-in passageway for breast tissue massage and/or massage of the area in between the breasts by an artificial or real penis.

U.S. Pat. No. 5,522,892, issued Jun. 4, 1996, to Lin, BREAST AUGMENTATION DEVICE, describes a breast augmentation device with a plurality of elongated grooves with vent holes and a plurality of elongated ribs. This breast falsie for padding a brassiere is used to give the impression of larger breasts. This breast augmentation device has grooves and ribs designed for ventilation in the hollow side of the device. The grooves and ribs of the breast augmentation device are not designed to allow an artificial or real penis to massage breast tissue and/or massage the area in between the breasts.

U.S. Pat. No. 5,807,160, issued Sep. 15, 1998, to Wehmeyer, CLEAVAGE WRINKLE PROTECTOR, discloses a cleavage wrinkle protector constructed of satin or similar lingerie type fabric and stuffed with polyester fibre-fill. The protector is designed to be worn between the woman's breasts while sleeping to protect the cleavage skin from folding when she lies on her side. This protector overlies the cleavage area, therefore, does not provide a built-in passageway for an artificial or real penis to massage the area in between the breasts.

U.S. Pat. No. 6,015,331, issued Jan. 18, 2000, to Ioakim, NIGHTTIME NURSING TUBE BRA, discloses a nighttime nursing tube bra that is a tube-top like brassiere that has an absorbent liner and has a first elastomeric band along the top edge and a second elastomeric band along the bottom edge. This tube brassiere does not have a built-in passageway for an artificial or real penis to massage in between the breasts and/or massage breast tissue. In addition, the elastomeric bands inhibit access to the breasts and the cleavage area for an artificial or real penis to massage breast tissue and/or to massage the area in between the breasts.

U.S. Pat. No. 6,769,955, issued Aug. 4, 2004 to Fisher, ANTI-WRINKLE BRA FOR SLEEPING, illustrates a brassiere which comprises a soft tube-like bra with a centre breast support insert. This insert is positioned between the breasts and supports the breasts when the wearer is lying on her side. This support helps to prevent the formation of wrinkles in the skin of the upper chest. The insert is shaped with a thick midsection, a back surface adapted for conforming to the chest surface between the breasts of the wearer and a concave curved cavity on each side of the vertical section adapted for supporting either breast of the wearer while on their side to prevent the breast in the upper position from hanging down toward the breast in the lower position. As the centre insert conforms to the chest surface between the breasts, this insert does not provide a built-in passageway that allows an artificial or real penis to massage breast tissue and/or massage the area in between the breasts.

U.S. Pat. No. 7,192,409, issued Mar. 20, 2007, to Lorenzo, COMFORT BANDAGE, illustrates a tube top-like band made of stretchy fabric with a semi-cylindrical shaped bolster centrally placed over the sternum which prevents lateral breast shifting in a side-laying position. When this band is worn, the semi-cylindrically shaped bolster does not have a passageway for mammary coitus as it conforms to the breast bone. The embodiment with fenestrations can allow for nipple and breast stimulation, however, there is no built-in passageway provided for the massage of breast tissue and/or the massage of the area in between the breasts by an artificial or real penis.

Pub. No. US 2010/0159801 A1, filed Apr. 29, 2009, to Abbaszadeh, PUMPING/NURSING BRA, discloses a hands-free pumping and nursing bra which comprises at least one band of material encircling the woman's chest, the band of material provided with two openings corresponding to the woman's breasts. A centre panel is provided to adjust the fit of the band. The design of this pumping/nursing bra does not have a passageway for massaging in between the breasts and/or massaging breast tissue by an artificial or real penis.

U.S. Pat. D626,656 S, issued Nov. 2, 2010, to Jarry, MASSAGER, discloses a massager with a number of shaped geometric views. In accordance with sales literature for the commercially available massager, the massager has built-in electronics, is ergonomic, and fits in the palm of a human hand. The massager is made of rigid ABS plastic with a soft touch top coat. The massager being made of rigid material is not deformable by a human hand. The massager does not have shape geometry and/or the material properties to be comfortably worn on the chest of a human and be used for the massage of breast tissue and/or massage of the area in between the breasts by an artificial or real penis.

Bearing guides, cable guides, and raceways have guideways. These guideways are not designed or engineered to have a comfortable and ergonomic passageway for breast tissue massage or for massaging the area between the breasts. Using hardened steel bearing guides may not be deemed suitable for use by the wearer and/or the person performing the massage.

Peek-a-boo bras, or rubber fetish wear with cut outs for nipples is common prior art and although these do indeed expose breast tissue, they do not have a built-in passageway for the massage of breast tissue and/or the massage of the area in between the breasts by an artificial or real penis.

For many individuals, cleavage may not be possible or sufficient to experience mammary coitus with conventional methods. This may be due to natural breast size, the loss of breast tissue due to various conditions such as surgery, hormonal changes, or weight loss. An appliance and method to allow all individuals to experience the massage and stimulation of mammary coitus despite breast tissue size is needed. There is significant research substantiating the benefits of breast massage, this further emphasizes the need for an appliance that provides a passageway independent of body contours that allow individuals to experience breast tissue massage and/or massage of the area in between the breasts.

OBJECTS AND ADVANTAGES

Accordingly, several objects and advantages of the sexual aid method and appliance with passageway for intimate massage are:

(a) to provide an appliance that provides a new healthy opportunity for individuals or couples to enjoy the benefits of breast massage comprising: increasing tissue oxygenation, draining of toxins, stimulating immunity, providing relaxation, strengthening and adding resiliency to breast tissue, relieving tightness in chest muscles, promoting lymphatic drainage and blood circulation in the breasts, increasing lactation, reducing pain, reducing congestion, reducing swelling related to PMS, reducing breast scars, alleviating tension, treating chronic diseases and injuries of breast tissue, mobilizing breast tissue, aiding to induce labour, stimulating healthy breast growth or natural breast enlargement, and increasing the flow of hormones throughout the body that aid in combating cancer;

(b) to provide an appliance that has built-in ergonomic passageways to be placed on the human body, independent of body contours, to allow for the massage of breast tissue and massage of the area between the breasts individually or with a partner;

(c) to provide an appliance that allows individuals to experience mammary coitus;

(d) to provide an appliance that allows individuals to experience hands free mammary coitus;

(e) to enhance stimulation for both partners during mammary coitus;

(f) to provide an alternative to breast massage by a therapist, which can be uncomfortable for some individuals;

(g) to provide an alternative sexual activity without vaginal, anal or oral penetration and with no bodily fluids intended to be exchanged at mucous membrane sites, thus reducing the risk of passing a sexually transmitted infection, such as HIV, that requires direct contact between the mucous membranes and pre-ejaculate or semen;

(h) to provide an appliance which offers couples new sensations to explore, adding diversity in the bedroom and decreasing the need to look outside the relationship for the desired change and or sensations, thus decreasing the transmission of AIDS and other sexually transmitted diseases and/or infections;

(i) to provide an appliance that can be used as a tool in couples' sexual therapy to offer new experiences;

(j) to allow couples who are expecting and who are not permitted to engage in intercourse a new way to enjoy pleasuring erogenous zones;

(k) to provide an appliance that can be used for the massage of other areas on the human body;

(l) to provide an appliance that can be manufactured with 100% recycled materials;

(m) to provide a green technology manufactured product that can be fully reclaimed or re-used, ending the 'cradle to grave cycle' of manufactured products;

(n) to provide a product that can be recycled and uses processes with minimal waste and by-products;

Further objects and advantages will become apparent from a consideration of the ensuing description and drawings.

SUMMARY

A sexual aid method and appliance with passageway for intimate massage comprises at least one passageway sized and shaped to guide an artificial or real penis over breast tissue and/or between the breasts of the wearer. This passageway can be chosen from the group comprising: sternum passageways, tube passageways, breast passageways, and passageway enhancers. Additionally, the sexual aid appliance has at least one passageway and none, one, or a plurality of the following elements in various combinations and configurations comprising: sternum passageways, tube passageways, breast passageways, breast tissue exposure holes, bands, attachment holes, entry lips, texture, recesses, breast contact areas, grooves, stabilizers, passageway enhancers, attachment rings, attachment tabs and means of attachment. The sexual aid appliance is designed to fit on the chest of a wearer. The sexual aid appliance offers an inexpensive and versatile solution to enjoying the vast array of health benefits of breast tissue massage and/or massage of the area between the breasts.

DRAWINGS

Figures

Reference Numerals

Figure 1:
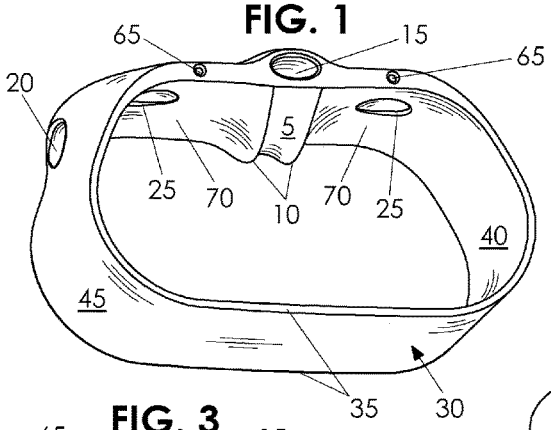
FIG. 1 is a perspective view of the sexual aid appliance in accordance with the first embodiment.

5 sternum passageway
10 passageway edge
15 tube passageway
20 breast passageway
25 breast tissue exposure hole
30 band
35 band edge
40 inner surface
45 outer surface
50 attachment hole
55 entry lip
60 texture
65 recess
70 breast contact area
75 groove
85 stabilizer
90 passageway enhancer
110 attachment ring
115 attachment tab
120 ultra-flexible passageway
200 breast
210 nipple The following components of the sexual aid appliance are considered to be massage elements: sternum passageways 5, tube passageways 15, breast passageways 20, breast tissue exposure holes 25, texture 60, recesses 65, and passageway enhancers 90. Passageways are built-in trajectories for the movement of an artificial or real penis. Additionally, there are breast contact areas 70 on all of the embodiments. The breast contact areas 70 denote the portions of the sexual aid appliance that come in contact with breast tissue. These areas are highlighted as breast contact areas 70 in the applicable illustrations for all of the embodiments.

DETAILED DESCRIPTION

FIGS. 1-11—First Embodiment

The first embodiment of the sexual aid appliance resembles a ladies' tube top with passageways illustrated in FIGS. 1-11. This embodiment features variations of the following components comprising: bands 30, attachment holes 50, sternum passageways 5, tube passageways 15, breast passageways 20, breast tissue exposure holes 25, recesses 65, stabilizers 85, grooves 75, breast contact areas 70 and means of attachment.

Bands 30—The first embodiment has a single band as illustrated in FIGS. 1-4. The band 30 is a thin, flat and elastic strip that encircles the torso of a wearer. The band 30 has band edges 35, an inner surface 40 and an outer surface 45 and is undersized for the chest circumference of the wearer to ensure a snug fit when stretched into position. The band 30 connects the massage elements onto the wearer and is sized and shaped to comfortably keep the appliance in position on the wearer.

Figure 6:
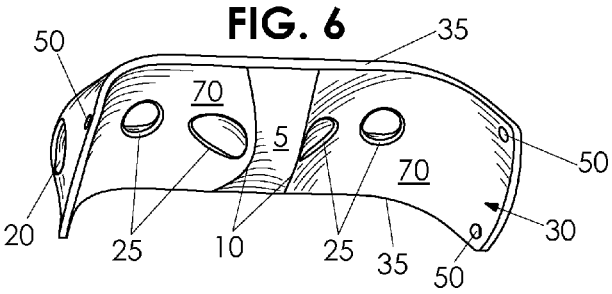
FIG. 6 is a perspective view of a variation of the sexual aid appliance of FIG. 1 with attachment holes, grooves, alternative breast tissue exposure holes, alternative breast passageways, an alternative partial band, no tube passageway, and no recesses in accordance with the first embodiment.
Figure 7:
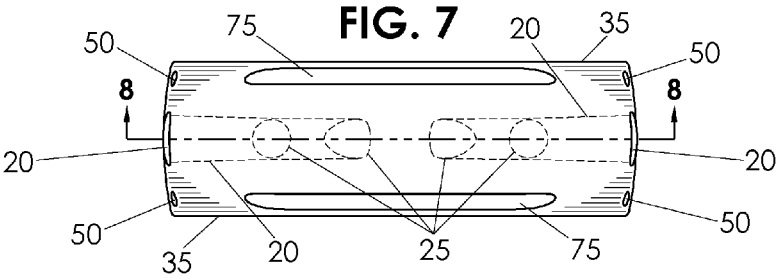
FIG. 7 is a top view of the sexual aid appliance of FIG. 6.
Figure 8:
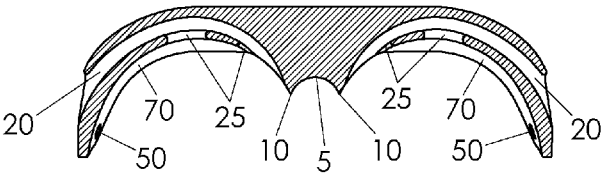
FIG. 8 is a cross-sectional view taken along 8-8 of the appliance of FIG. 7.

Alternatively, the band 30 can partially encircle the wearer as illustrated in FIGS. 6-8. The appliance in FIGS. 6-8 has four attachment holes 50, two on each side of the appliance. The attachment holes 50 are a means for attaching the appliance to the wearer; straps, ties, laces, etc. can be utilized in conjunction with the attachment holes 50 to secure the appliance in position on the wearer.

Variations of bands 30 of the first embodiment comprise: various sized bands; bands with various cross-sectional geometry; bands with thicker band edges; bands comprised of multiple pieces; bands with none, one or a plurality of attachment holes; bands of varying thicknesses; bands with varying configurations to modulate the elasticity; bands that allow for various means of adjusting the fit; any alternative methods of securing the appliance in position on the wearer comprising: holding with hands, friction hold, tapes, adhesives, straps, buttons, hook and loop fasteners, ties, rings, snaps, zippers, etc.; and any band that connects a massage element or massage elements of the appliance to the wearer. There can be none, one, or a plurality of bands on the sexual aid appliance.

Figure 2:
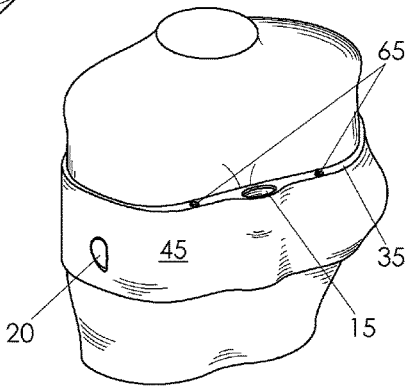
FIG. 2 is a perspective view of the appliance of FIG. 1 in position on the chest of the wearer.
Figure 3:
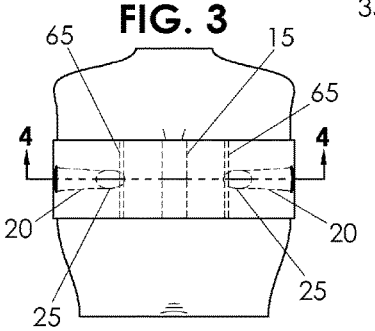
FIG. 3 is a front view of the appliance of FIG. 2 in position on the chest of the wearer.
Figure 4:
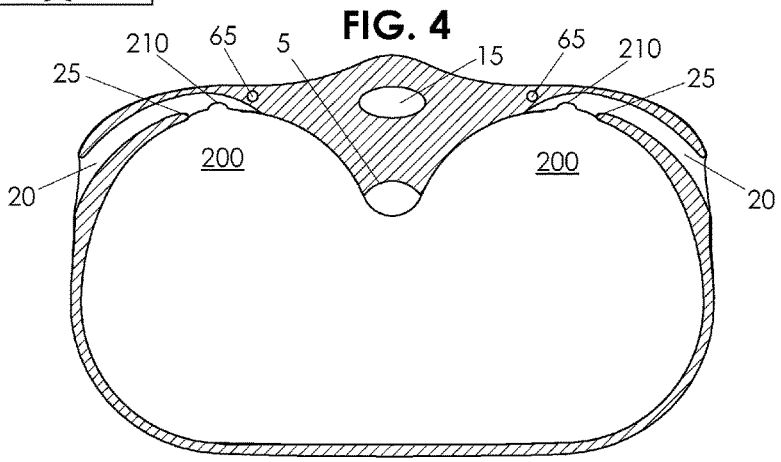
FIG. 4 is a cross-sectional view taken along 4-4 of FIG. 3.

Sternum Passageways 5—The first embodiment has a concave shaped sternum passageway 5 as illustrated in FIGS. 1-4. The sternum passageway 5 is located on the band's inner surface 40, spanning between one band edge 35 and the opposite band edge 35. The sternum passageway 5 has passageway edges 10 on either side of the sternum passageway 5. The sternum passageway 5 is sized and shaped to be a passageway for an artificial or real penis to move between the skin of the wearer and the sexual aid appliance, and between the breasts of the wearer. The sternum passageway 5 serves as a breast massage element of the sexual aid appliance. When in position, the sternum passageway 5 is located adjacent to the skin covering the sternum and between the breasts 200 of the human wearer as illustrated in FIGS. 2-4. When an artificial or real penis moves in the sternum passageway 5, when in position on the wearer, the breast tissue on either side of the sternum passageway 5 is massaged and the area in between the breasts 200 is massaged. The size and shape of the sternum passageway 5 allows for flexing of the passageway edges 10, inducing further massage of the breast tissue in contact with the breast contact areas 70 near the sternum passageway 5. This area of massage is broadened by the flexural characteristics of the sternum passageway 5. The sternum passageway 5 of the first embodiment is in general alignment between the breasts of the wearer and serves to guide an artificial or real penis between a pair of breasts, the appliance and the wearer.

Variations of sternum passageways 5 of the first embodiment comprise: various geometric concave (hollowed inward) cross-sectional shapes: semi-circular, irregular, inverted V, and any combinations thereof, etc.; passageway edges 10 that have various shaped geometry comprising: passageway edges that are divergent, convergent, parallel, wavy, irregular, and any combination thereof, etc.; passageway edges that are radiused; passageways modulated with a passageway enhancer 90 (described in detail in the second embodiment); passageways that have none, a portion, or a complete bridge of material between the passageway edges; passageways that have a reservoir end; various entry and exit lip geometry configurations; passageways with or without texture; passageways with none, one, or a plurality of holes; passageways that connect to other massage elements; passageways oriented at various angles to the sternum; and any sternum passageway that is sized and shaped to be a passageway that allows for the movement of an artificial or real penis between the skin of the wearer, the appliance and a pair of breasts. There can be none, one, or a plurality of sternum passageways on any sexual aid appliance.

Tube Passageways 15—The first embodiment has one tube passageway 15 as illustrated in FIGS. 1-4. The tube passageway 15 has an elliptically shaped cross-section and is located on top of and generally aligned with the sternum passageway 5. The tube passageway 15 length spans between one band edge 35 and the opposite band edge 35. The tube passageway 15 is sized and shaped to be a passageway for movement of an artificial or real penis between a pair of breasts. The tube passageway 15 serves as a breast massage element of the sexual aid appliance. As an artificial or real penis moves within the tube passageway 15, the breast tissue on either side of the tube passageway 15 is massaged. The size and shape of the tube passageway 15 allows for flexing of the appliance, broadening the massaged area of the breast tissue in contact with the breast contact areas 70 near the tube passageway 15.

Figure 9:
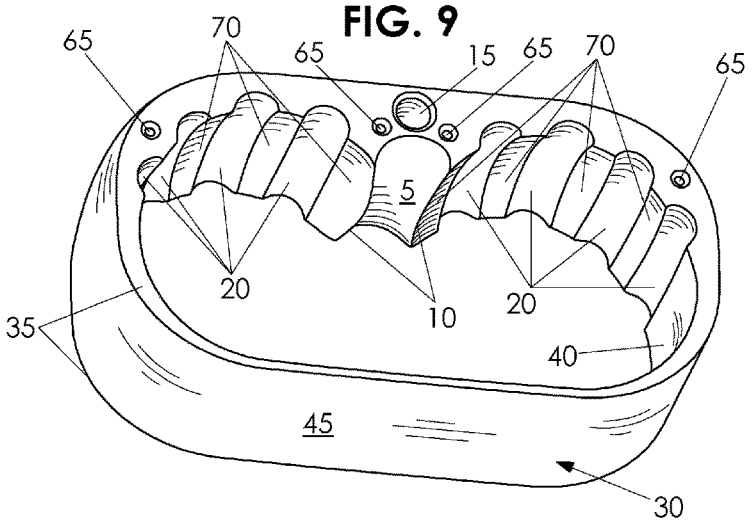
FIG. 9 is a perspective view of a variation of the sexual aid appliance of FIG. 1 with alternative breast passageways, alternative tube passageway, alternative recesses and no breast tissue exposure holes in accordance with the first embodiment.
Figure 10:
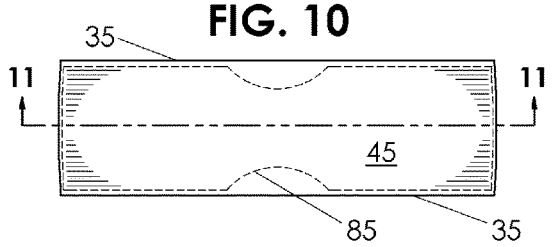
FIG. 10 is a top view of the appliance of FIG. 9.
Figure 11:
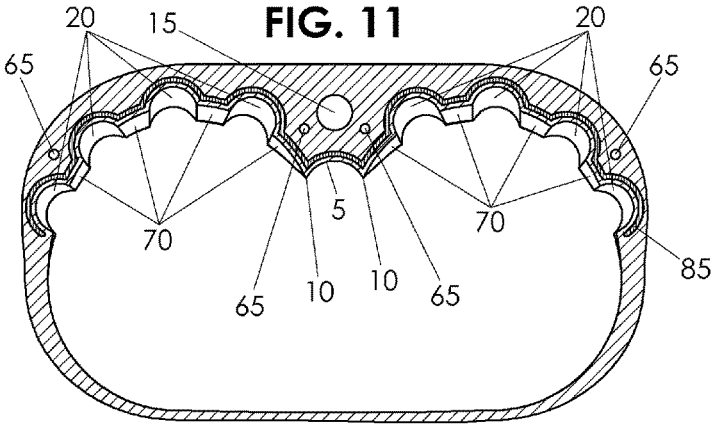
FIG. 11 is a cross-sectional view taken along 11-11 of the appliance of FIG. 10.

Alternatively, there can be no tube passageway 15 as illustrated in FIGS. 5-8. Alternatively, the tube passageway 15 can have a circular shaped cross-section as illustrated in FIGS. 9-11.

Variations of tube passageways 15 of the first embodiment comprise: various cross-sectional shapes comprising: circular, elliptical, organic rectangular, organic trapezoidal, polygonal, octagonal or irregular shapes, and combinations thereof, etc.; passageways that are arced, parabolic, wavy, or irregular in direction; various entry and exit lip geometry configurations; passageways with or without texture; passageways with none, one, or a plurality of holes; passageways that connect to other massage elements; passageways oriented at various angles to the sternum; passageways that have a reservoir end or one end closed; and any tube passageway that is sized and shaped to be a passageway for movement of an artificial or real penis within the appliance and between a pair of breasts. There can be none, one, or a plurality of tube passageways on any sexual aid appliance.

Breast Passageways 20—The first embodiment has two breast passageways 20 as illustrated in FIGS. 1-4. The breast passageways 20 are symmetrically located on either side of the sternum passageway 5 on the band's outer surface 45. The breast passageways 20 are parallel to the band edges 35 and are equidistant from the band edges 35. The breast passageways 20 are sized and shaped to be a passageway over the breast tissue of the wearer. The breast passageways 20 serve as breast massage elements of the sexual aid appliance. As an artificial or real penis moves within the breast passageway 20, the breast tissue underneath and on either side of the breast passageway 20 is massaged. The size and shape of the breast passageway 20 allows for flexing of the appliance, broadening the massaged area of the breast tissue in contact with the breast contact areas 70 near the breast passageway 20. Within the breast passageways 20, there can be breast tissue exposure holes 25. These breast tissue exposure holes 25 allow for massage of breast tissue when an object enters the breast passageway 20 and slides over and/or through the breast tissue exposure hole 25.

Figure 5:
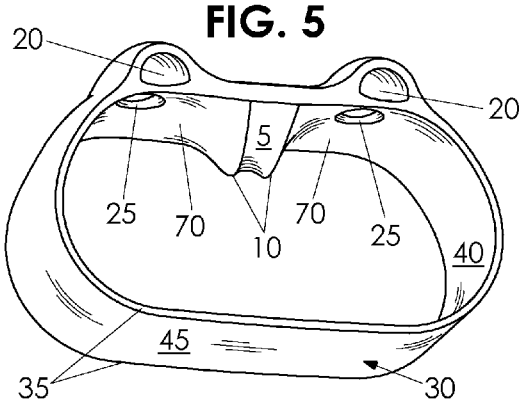
FIG. 5 is a perspective view of a variation of the sexual aid appliance of FIG. 1 with no tube passageway, no recesses, alternative breast tissue exposure holes and alternative breast passageways in accordance with the first embodiment.

Alternatively, breast passageways 20 can be generally aligned parallel to the sternum of the wearer with one breast tissue exposure hole 25 per breast passageway 20 as illustrated in FIG. 5. Alternatively, breast passageways 20 can be generally aligned parallel to the band edges 35 of the appliance and each breast passageway 20 can have two breast tissue exposure holes 25 as illustrated in FIGS. 6-8. Alternatively, there can be a plurality of breast passageways 20 as illustrated in FIGS. 9-11. In this illustration, there are four concave breast passageways 20 with semi-circular cross-sections positioned over each breast 200 to enable the massage of different regions of each breast. These breast passageways 20 allow full skin contact with the breast along the entire length of the breast passageway 20 by an artificial or real penis.

Variations of breast passageways 20 of the first embodiment comprise: passageways that are symmetrical or asymmetrical in location on the appliance; passageways with none, one or a plurality of breast tissue exposure holes; various cross-sectional shapes comprising: circular, polygonal, octagonal or irregular shapes, and combinations thereof, etc.; passageways that are arced, parabolic, wavy, or irregular in direction; various entry and exit lip geometry configurations; passageways with or without texture; passageways with none, one, or a plurality of holes; passageways that connect to other massage elements; passageways oriented at various angles to the band edges; passageways that have none, a portion of, or a complete bridge of material between the passageway edges (the bridge of material can serve to prevent the collapse of a breast passageway); passageways that have a reservoir end or one end closed; and any breast passageway that is sized and shaped to be a passageway for the movement of an artificial or real penis over breast tissue. There can be none, one, or a plurality of breast passageways on any sexual aid appliance.

Breast Tissue Exposure Holes 25—The first embodiment has two breast tissue exposure holes 25 as illustrated in FIGS. 1-4. The breast tissue exposure holes 25 are symmetrically located on either side of the sternum passageway 5 on the band inner surface 40 and are sized and shaped to expose breast tissue to an artificial or real penis that is introduced into a breast passageway 20. In this embodiment, the breast tissue exposure holes 25 are elliptical in shape and are located to expose sensitive breast tissue areas such as the nipples 210 as illustrated in FIG. 4.

Alternatively, breast tissue exposure holes 25 can have circular cross-sectional shapes as illustrated in FIG. 5. Alternatively, the sexual aid appliance can have four breast tissue exposure holes 25 as illustrated in FIGS. 6-8, one circular shaped and one irregular shaped breast tissue exposure hole 25 on each side of the appliance. Alternatively, there can be no breast tissue exposure holes 25 as illustrated in FIGS. 9-11.

Variations of breast tissue exposure holes 25 of the first embodiment comprise: various shapes comprising, circular, rectangular, octagonal, polygonal, irregular shapes, or any shape that exposes breast tissue to an artificial or real penis being introduced into the breast passageways, tube passageways or sternum passageways; the breast tissue exposure holes can be arranged symmetrically or asymmetrically in location on the sexual aid appliance. There can be none, one or plurality of breast tissue exposure holes on any sexual aid appliance.

Recesses 65—The first embodiment has two recesses 65 as illustrated in FIGS. 1-4. The recesses 65 are circular in cross-section and are symmetrically located on either side of the sternum passageway 5 and are located within the thickness of the band 30. The recess' 65 length spans between one band edge 35 and the opposite band edge 35. The recesses 65 are designed to hold none, one or a plurality of devices comprising; devices that create stimulation to the skin and/or breast tissue, vibrating devices, pulsating devices, pellet-rotating devices, oscillating devices, heating devices, hard object devices (for example balls), suction devices, motorized devices, or any type of device that would serve to stimulate and/or massage. With the correct choice of materials for the sexual aid appliance, the vibrations, pulses, heating, and/or properties from stimulation devices will be transmitted throughout the appliance or in localized regions. Similarly, none, one or a plurality of devices that create stimulation to the skin and or breast tissue can be inserted into any orifice of the appliance or inserted anywhere under the appliance or placed anywhere on top of the appliance.

Alternatively, there can be no recesses 65 in the sexual aid appliance as illustrated in FIGS. 5-8. Alternatively, there can be four recesses 65 as illustrated in FIGS. 9-11. Two recesses 65 are symmetrically located on either side of the sternum passageway 5 and two recesses 65 are symmetrically located on the outer regions of the band 30.

Variations of recesses 65 of the first embodiment comprise: recesses piercing through the entire appliance; recesses having various cross-sectional shapes comprising: circular, polygonal, octagonal or irregular shapes, and combinations thereof, etc.; recesses that are arced, straight, parabolic, wavy, or irregular in direction; various entry and exit lip geometry configurations; recesses with or without texture; recesses with none, one, or a plurality of holes; recesses that connect to other massage elements; recesses oriented at various angles to the sternum and/or the band edges; recesses that are closed with built in stimulation devices; recesses having one end closed; and any recess that is sized and shaped to create a void within the appliance for holding none, one, or a plurality of stimulation devices. There can be none, one, or a plurality of recesses on any sexual aid appliance.

Stabilizers 85—The stabilizer 85 of the first embodiment is illustrated in FIGS. 9-11. The stabilizer 85 is embedded in the band 30 and follows the contour of the breast passageways 20 and sternum passageway 5 as illustrated in FIG. 11. The stabilizer 85 serves to aid in retaining the shape of the passageways such that when the band 30 is stretched into position on the wearer, the passageways do not collapse. The stabilizer 85 also serves to aid in transmitting the massaging effects from the movement of an artificial or real penis within passageways. The stabilizer 85 aids in transmitting stimulation from stimulation devices used with the appliance.

Variations of stabilizers 85 of the first embodiment comprise: various sized stabilizers; stabilizers with various cross-sectional geometry; stabilizers with none, one or a plurality of attachment holes; stabilizers of varying thicknesses; stabilizers with varying configurations to modulate the elasticity; stabilizers made with differing materials, stabilizers that serve to reinforce a passageway enhancer and any alternative stabilizer that serves to aid in maintaining and supporting the shape of any part of the sexual aid appliance and/or serves to transmit the massaging effects from movement within the passageways. There can be none, one, or a plurality of stabilizers on any outer surface of or embedded within any sexual aid appliance.

Grooves 75—The first embodiment of the sexual aid appliance has two grooves 75 as illustrated in FIG. 7. The grooves 75 are located on the outer surface 45 of the appliance. The grooves 75 are designed and function to accept any means of securing the appliance in place on the wearer comprising: fingers, ladies' common garment for covering the breasts (for example: ladies' tube top, brassiere, etc.), straps, etc. The grooves 75 also allow for attachment of auxiliary appliances (described in detail as a passageway enhancer 90 in the second embodiment).

Variations of grooves 75 of the first embodiment comprise: various cross-sectional shapes, grooves with various geometric shapes comprising: ovals, rectangles, irregular shapes, etc., grooves oriented in any direction, grooves with or without texture, grooves at any depth, and any groove that accepts any means of securing the appliance in place on the wearer comprising: adhesives, hook and loop fasteners, straps, hook-like protrusions, etc. There can be none, one, or a plurality of grooves on any sexual aid appliance.

Material—First Embodiment

The first embodiment of the sexual aid appliance, excluding the stabilizer 85, is made of medical-grade silicone, rubber, elastomer or elastomeric gel with a durometer measuring between 1-20 on the Shore 00 scale of hardness. However, the sexual aid appliance can be made with any material that comprises the following characteristics. The material should be soft, elastic, flexible and deformable by human fingers without permanent deformation. The material should also be stable and capable of multiple washings without deterioration. The material should also have the density and tactile feel of human flesh and be capable of readily transmitting sensations throughout. The material should conform to the body contours while preserving a degree of passageway shape geometry when in position on the wearer. The material when penetrated by an artificial or real penis should readily deform and flex to induce a massaging effect that broadens the area of massage by the penetrating object. The elastic nature of the material enhances the effect of the penetrating object.

An additional material is required for the stabilizer 85. The preferred material for the manufacture of the stabilizer 85 is a medical-grade silicone, rubber, elastomer or elastomeric gel with a durometer measurement of between 10-60 on the Shore A scale of hardness. The stabilizer 85 is preferably constructed from a similar material with similar properties used for the first embodiment, albeit more rigid. The rigidity of the stabilizer 85 is dependent upon the thickness of the stabilizer 85 and the durometer of the material used for the stabilizer 85. A thicker stabilizer 85 having a lower durometer material can have the same rigidity and flexural properties as a thinner stabilizer 85 having a higher durometer material. Material with durometers outside of the stated preferred range of durometers can be used depending on the shape, geometry and characteristics for the stabilizer. Alternatively, the stabilizer 85 can be made of any type of material (metal, plastic, wood, etc) that is more rigid than the material for the first embodiment.

Manufacturing—First Embodiment

The sexual aid appliance with no stabilizer 85 can be molded with conventional manufacturing methods comprising: conventional injection molding techniques and technologies, extrusion techniques and technologies, gravity-fed molding techniques, poured-molding techniques or any technology that allows for the forming of material into a desired shape.

The stabilizer 85 can be molded with conventional manufacturing methods comprising: conventional injection molding techniques and technologies, extrusion techniques and technologies, gravity-fed molding techniques, poured-molding techniques or any technology that allows for the forming of material into a desired shape.

The first embodiment with stabilizer 85 as illustrated in FIGS. 9-11 can be manufactured using conventional over-molding techniques and technologies or any technology that over-molds a plurality of dissimilar materials together.

Although the sexual aid appliance is illustrated as an injected molded part in FIGS. 9-11, whereby the appliance is molded with a curvature for each breast and has smooth rounded entry lips on each passageway for comfort as the appliance is penetrated by a human penis, the appliance can be extruded. In the case of an extruded appliance, the entrance to each passageway will not be rounded without post-processing of the cut-to-length extrusion. Due to the material's elastic nature, post processing to create a smooth entry lip and smooth edges is difficult as is maintaining consistency and repeatability on each passageway entry lip and/or edge. Therefore, injection molding is the preferred method for manufacturing the appliance.

Operation—FIGS. 1-11—First Embodiment

The first embodiment as illustrated in FIGS. 1-5, 9-11 of the sexual aid appliance having a full band 30 is undersized for the chest circumference of the wearer. The appliance is stretched by hand and is placed over the head of the wearer or stepped into and fit around the chest area. In the first embodiment, a partial band 30 is illustrated in FIGS. 6-8. This appliance can be secured in place by various methods comprising: holding with a hand or hands, tapes, adhesives, straps, buttons, hook and loop fasteners, etc. The sternum passageway 5 of the appliance is positioned to fit in between the breasts 200, in general alignment with the sternum of the wearer. The breast tissue exposure holes 25 are placed over the nipples 210 as illustrated in FIGS. 2-4, or a preferred location determined by the wearer.

Next, a lubricant is applied to the areas of the appliance and to the skin of the wearer where an artificial or real penis will be moving. The artificial or real penis can then be inserted into the lubricated area to massage the breast tissue or massage the area in between the breasts. Optionally, none, one or a plurality of stimulation devices such as, but not limited to, vibrating bullets, heating devices or motorized massaging devices can be inserted into any orifice of the appliance or inserted anywhere under the appliance or placed anywhere on top of the appliance.

After use, the sexual aid appliance can be removed, disassembled if required, cleaned and reused.

FIGS. 12-31—Second Embodiment

The second embodiment of the sexual aid appliance illustrated in FIGS. 12-31 features variations of the following components comprising: sternum passageways 5, tube passageways 15, breast passageways 20, breast tissue exposure holes 25, recesses 65, stabilizers 85, grooves 75, attachment holes 50, attachment tabs 115, textures 60, breast contact areas 70, passageway enhancers 90 and means of attachment.

Sternum Passageways 5—The sternum passageway 5 of the second embodiment as illustrated in FIGS. 12-24 has similar features, structure and characteristics as the sternum passageway 5 in the first embodiment. The sternum passageway 5 is sized and shaped to be a passageway for movement of an artificial or real penis between the skin of the wearer, the appliance and a pair of breasts.

Figure 19:
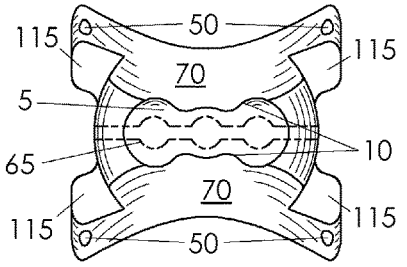

Alternatively, the passageway edges 10 of the sternum passageway 5 of the second embodiment can have various configurations: converging (illustrated in FIG. 16), parallel (illustrated in FIG. 17), diverging (illustrated in FIG. 18), and any combination thereof (illustrated in FIG. 19). Alternatively, the sternum passageway 5 can have various geometric concave (hollowed inward) cross-sectional end view shapes: semicircular (illustrated in FIG. 13), irregular (illustrated in FIG. 14), and inverted 'V' (illustrated in FIG. 15).

Variations of sternum passageways 5 of the second embodiment comprise the same variations for sternum passageways as stipulated in the first embodiment.

Tube Passageways 15—The tube passageway 15 of the second embodiment as illustrated in FIGS. 12-15, 24 has similar features, structure and characteristics as the tube passageway 15 in the first embodiment. The tube passageway 15 is sized and shaped to be a passageway for movement of an artificial or real penis within the appliance and between a pair of breasts. Various configurations of the tube passageway 15 can induce flexing of the sexual aid appliance that further massages breast tissue.

Figure 14:
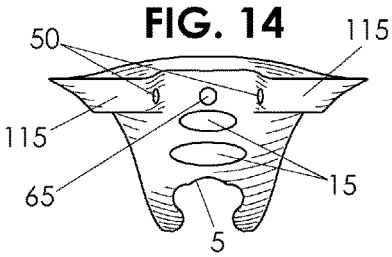
Figure 15:
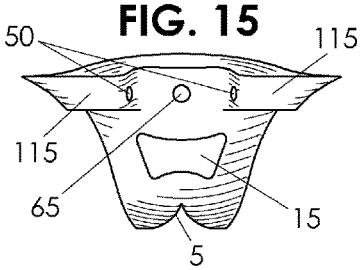
Figure 16:
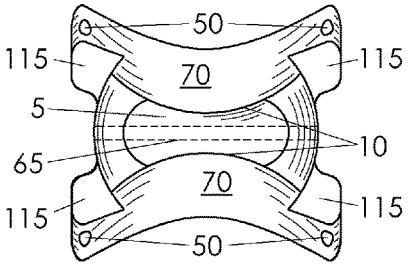
FIGS. 16-19 show bottom views of variations of the sexual aid appliance of FIG. 12 with alternative recesses, alternative passageway edges, alternative attachment holes and no texture in accordance with the second embodiment.
Figure 17:
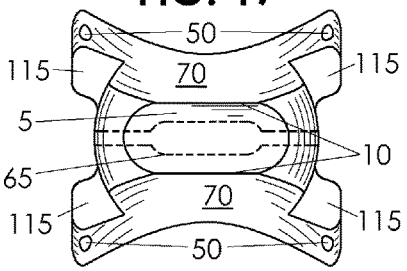
Figure 18:
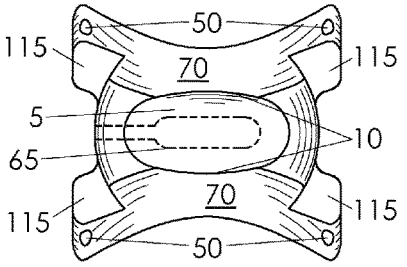

Alternatively, the tube passageway 15 of the second embodiment can have various cross-sectional configurations: organic rectangular with texture 60 (illustrated in FIG. 12), circular (illustrated in FIG. 13), elliptical (illustrated in FIGS. 14, 24), and organic trapezoidal (illustrated in FIG. 15). Alternatively, the tube passageway 15 of FIG. 15 is shaped such that when an object slides in, the upper and lower convex surfaces become concave as an object penetrates the appliance. This flexes the appliance and causes the adjacent side walls to flex inward. Furthermore, this flexing mechanism with the convex surfaces can be designed to flex the breast contact areas 70 of the appliance outward into the breast tissue. Alternatively, there can be more than one tube passageway 15 as illustrated in FIG. 14. Alternatively, the tube passageway 15 can have breast tissue exposure holes 25 as illustrated in FIG. 24.

Variations of tube passageways 15 of the second embodiment comprise the same variations for tube passageways as stipulated in the first embodiment. Variations of breast tissue exposure holes 25 of the second embodiment comprise the same variations for breast tissue exposure holes as stipulated in the first embodiment.

Figure 24:
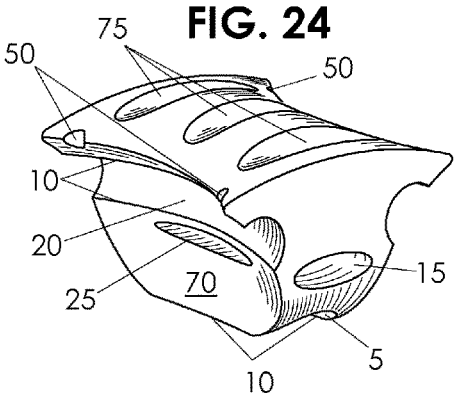
FIG. 24 is a perspective view of a variation of the sexual aid appliance of FIG. 12 with breast passageways, breast tissue exposure holes, alternative grooves, alternative tube passageway, alternative attachment holes, no texture, no recess and no attachment tabs, in accordance with the second embodiment.

Breast Passageway 20—The breast passageways 20 of the second embodiment as illustrated in FIG. 24 have similar features, structure and characteristics as the breast passageways 20 in the first embodiment. The breast passageways 20 are sized and shaped to have passageways for movement of an artificial or real penis over breast tissue of the wearer. FIG. 24 illustrates breast passageways 20 on either side of the appliance that serve to enable massage of breast tissue when the appliance is in place between the breasts of the wearer.

Variations of breast passageways 20 of the second embodiment comprise the same variations for breast passageways as stipulated in the first embodiment.

Recesses 65—The recess 65 of the second embodiment as illustrated in FIGS. 12-16 has similar features, structure and characteristics as the recesses 65 in the first embodiment. The recess 65 is designed to hold none, one or a plurality of stimulation devices as stipulated in the first embodiment.

Alternatively, the recess 65 of the second embodiment can have various configurations: straight tube (illustrated in FIG. 16), small-to-large-to-small tube (illustrated in FIG. 17), small-to-large tube with closed end (illustrated in FIG. 18), and an irregular shaped tube (illustrated in FIG. 19).

Variations of recesses 65 of the second embodiment comprise the same variations for recesses as stipulated in the first embodiment.

Figure 20:
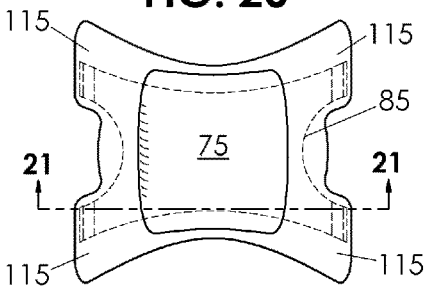
FIG. 20 is a top view of a variation of the sexual aid appliance of FIG. 12 with an embedded stabilizer and no texture in accordance with the second embodiment.
Figure 21:
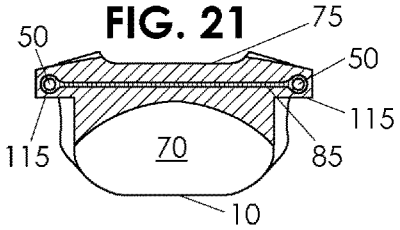
FIG. 21 is a cross sectional view taken along 21-21 of the appliance of FIG. 20.

Stabilizers 85—The stabilizer 85 of the second embodiment as illustrated in FIGS. 20-21 has similar features, structure and characteristics as the stabilizer 85 in the first embodiment. The stabilizer 85 is embedded in and generally follows the shape of the top surface of the appliance. The stabilizer 85 spans the attachment holes 50 to aid in supporting and restricting the material from deflecting excessively when a means of attaching via attachment holes 50 is used. The stabilizer 85 serves to aid in retaining the shape of the appliance and to distribute the pressure used for securing the appliance in place.

Figure 22:
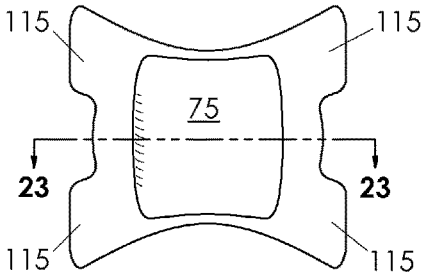
FIG. 22 is a top view of a variation of the sexual aid appliance of FIG. 20 with an alternative stabilizer and no tube passageway in accordance with the second embodiment.
Figure 23:
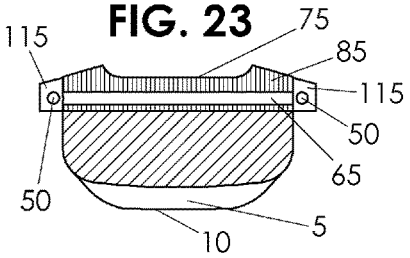
FIG. 23 is a cross sectional view taken along 23-23 of the appliance of FIG. 22.

Alternatively, the entire upper portion of the appliance can be made of a more rigid material and serve as a stabilizer 85 as illustrated in FIGS. 22-23. Having the whole upper portion of the appliance serving as a stabilizer 85 restricts the deformation of the appliance and of the attachment holes 50 and distributes the pressure being applied to secure the appliance in place. In addition, the recess 65 being within the more rigid material has a higher degree of transmitting the effects of the additional stimulation from any stimulation device placed within the recess 65 throughout the entire appliance.

Variations of stabilizers 85 of the second embodiment comprise the same variations for stabilizers as stipulated in the first embodiment.

Grooves 75—The single groove 75 of the second embodiment as illustrated in FIGS. 12, 20-23 has similar features, structure and characteristics as the grooves 75 of the first embodiment. The surface opposite the sternum passageway 5 is the top surface of the sexual aid appliance. The top surface is domed and has a flat-shaped rectangular depression, the groove 75. The groove 75 allows for locating an appliance under a means of attachment and/or attaching a passageway enhancer 90. The groove 75 is designed and functions to accept any means of securing the appliance in place on the wearer comprising: fingers, ladies' common garment for covering the breasts (example: ladies' tube top, brassiere, etc.), straps, etc.

Alternatively, the appliance can have multiple grooves 75 as illustrated in FIG. 24. These multiple grooves 75 allow for variability in the positioning of the appliance for comfort.

Variations of grooves 75 of the second embodiment comprise the same variations for grooves as stipulated in the first embodiment.

Attachment Holes 50/Attachment Tabs 115—The second embodiment of the sexual aid appliance has attachment tabs 115 that extend from the top surface of the appliance. Each attachment tab 115 has an attachment hole 50. These attachment holes 50 pierce through the attachment tabs 115 and are perpendicular to the axis of the tube passageway 15. The attachment holes 50 can be used for securing the appliance in position on the wearer.

Figure 25:
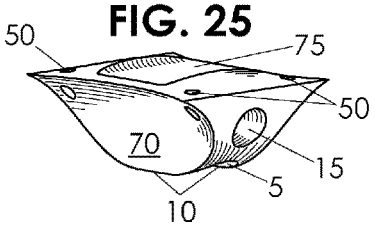
FIG. 25 is a perspective view of a variation of the sexual aid appliance of FIG. 12 with an alternative tube passageway, alternative attachment holes, no recess, no attachment tabs, and no texture in accordance with the second embodiment.

Alternatively, there can be no attachment tabs 115 and there can be two attachment holes 50 that are generally parallel to the top surface and perpendicular to the axis of the tube passageway of the second embodiment and that pierce entirely through the appliance as illustrated in FIG. 24. Alternatively, the attachment holes 50 can be perpendicular to the top surface of the appliance as illustrated in FIG. 25.

Variations of attachment tabs 115 of the second embodiment comprise: tabs that can be symmetrically, asymmetrically, or randomly located on the appliance; tabs that can have various shapes including hooks; and any attachment tab 115 that is sized and shaped to enable a means of attaching the appliance to the wearer. There can be none, one, or a plurality of attachment tabs 115 in any of the sexual aid appliances.

Variations of attachment holes 50 of the second embodiment comprise: holes that can be symmetrically, asymmetrically, or randomly located on the appliance; holes that can have various shapes; and any attachment hole 50 that is sized and shaped to enable a means of attaching the appliance to the wearer. There can be none, one, or a plurality of attachment holes 50 in any of the sexual aid appliances.

Figure 12:
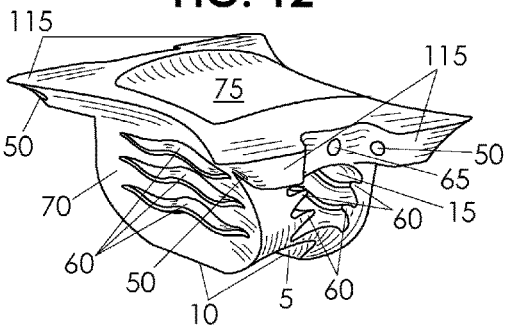
FIG. 12 is a perspective view of the sexual aid appliance in accordance with the second embodiment.
Figure 13:
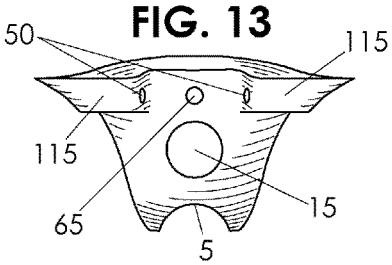
FIGS. 13-15 show end views of variations of the sexual aid appliance of FIG. 12 with alternative tube passageways, alternative sternum passageways and no texture in accordance with the second embodiment.

Texture 60—The second embodiment of the sexual aid appliance has texture 60 on the breast contact areas 70 as illustrated in FIG. 12. The breast contact areas 70 are the surfaces of the appliance adjacent to the breast tissue when the appliance is in place between the breasts of a wearer. The breast contact areas 70 are contoured to fit the curvature of the breasts and can have texture 60 that increases stimulation to the breast tissue while the appliance is in use. Although the texture 60 on the breast contact areas 70 of the sexual aid appliance is illustrated to have wave-like projections in FIG. 12, the surface of the sexual aid appliance is not limited to this type of texture 60. Texture 60 can comprise: round half spheres, dimples, finger-like projections, and any means of changing the feel, flexibility or consistency of any surface or no texture 60 at all. The texture 60 serves to induce a deeper massage of the breast tissue or induce altered stimulations to a human penis.

There is texture 60 within the tube passageway 15 as illustrated in FIG. 12. This texture 60, in the shape of wave-like projections, provides additional stimulation to an inserted penis. Furthermore, due to the elastic nature of the material, when the texture 60 in the tube passageway 15 moves as a result of the movement of an artificial or real penis, the texture 60 on the breast contact areas 70 moves and massages breast tissue.

Variations of texture 60 of the second embodiment comprise: texture on any of the surfaces of the massage elements; texture on any surface to aid in retaining the appliance in position on the wearer; texture within the recesses to aid in holding stimulation devices in place; texture that can create a passageway on the sexual aid appliance; texture that can create an entry lip; texture that can create a groove; and any means of changing the feel or material consistency of the surface of any sexual aid appliance.

Figure 26:
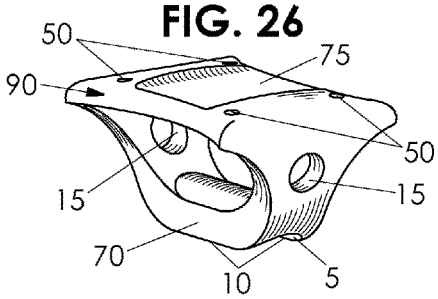
FIG. 26 is a perspective view of a passageway enhancer, a variation of the sexual aid appliance of FIG. 12 with a means of attachment, an alternative tube passageway, alternative attachment holes, alternative breast contact areas, no recess, no attachment tabs, and no texture, in accordance with the second embodiment.
Figure 27:
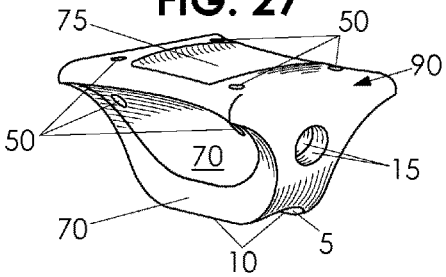
FIG. 27 is a perspective view of the appliance of FIG. 25 interlocked with the passageway enhancer of FIG. 26 in accordance with the second embodiment.
Figure 28:
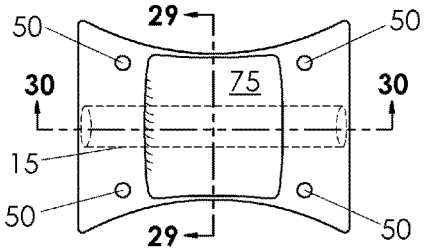
FIG. 28 is a top view of the appliance of FIG. 27.
Figure 29:
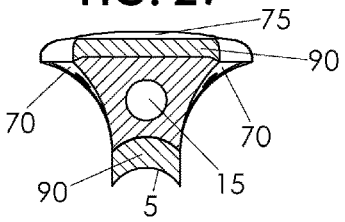
FIG. 29 is a cross-sectional view taken along 29-29 of the appliance of FIG. 28.
Figure 30:
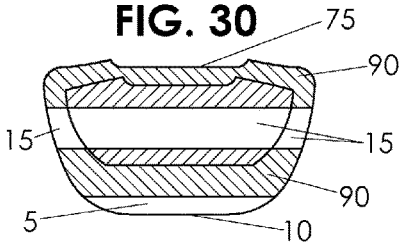
FIG. 30 is a cross-sectional view taken along 30-30 of the appliance of FIG. 28.

Passageway Enhancers 90—The passageway enhancer 90 of the second embodiment illustrated in FIGS. 25-30 comprises: a sternum passageway 5, a tube passageway 15, four attachment holes 50, a groove 75 and a means of attachment. FIG. 25 illustrates a receptive appliance of the second embodiment and FIG. 26 illustrates a passageway enhancer 90 of the second embodiment. The passageway enhancer 90 is slightly undersized and designed to be stretched and pressed onto a receptive sexual aid appliance as illustrated in FIG. 27. The surface opposite the sternum passageway 5 of the passageway enhancer 90 has a convex surface shape that interlocks with the concave surface shape of the sternum passageway 5 of the receptive sexual aid appliance. The passageway enhancer 90 has material in the top portion (opposite to the groove 75) of the passageway enhancer 90 that protrudes towards the sternum passageway 5 of the passageway enhancer 90. This protruding material interlocks within the groove 75 of the receptive appliance. In this configuration, the receptive appliance is secured within the passageway enhancer 90. The attachment holes 50 of the passageway enhancer 90 line up with the attachment holes 50 of the receptive appliance and allow for a means of attaching the sexual aid appliance to a wearer. The attachment holes 50 of the passageway enhancer 90 can serve to secure the passageway enhancer 90 to the receptive appliance. The passageway enhancer 90 offers an inexpensive means of expanding the variability of a sexual aid appliance with passageway for intimate massage. A passageway enhancer 90 can be assembled to a receptive sexual aid appliance to enhance the massage elements and/or other features (example: shape, size, configuration, etc.) of the sexual aid appliance.

Figure 31:
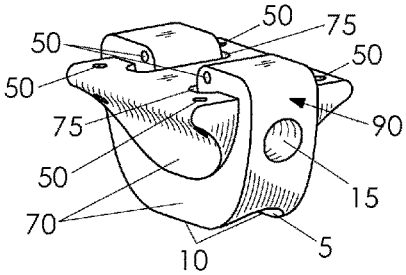
FIG. 31 is a perspective view of a variation of the appliance of FIG. 27 with an alternative means of attachment, alternative attachment holes, alternative grooves, and an alternative passageway enhancer in accordance with the second embodiment.
Figure 32:
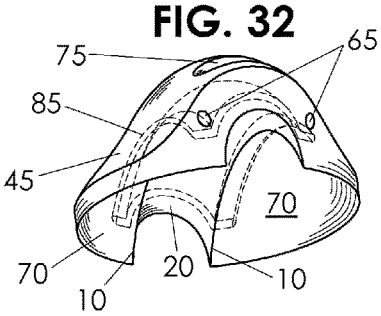
FIG. 32 is a perspective view of the sexual aid appliance in accordance with the third embodiment.

Alternatively, the passageway enhancer 90 has an alternative means of attachment as illustrated in FIG. 31. This passageway enhancer 90 is designed to clip onto a receptive first and/or second embodiment. In this illustration, the passageway enhancer 90 has no stabilizer 85 to aid in securing the passageway enhancer 90 onto the appliance, however, the passageway enhancer 90 has two attachment holes 50 for securing the passageway enhancer 90 to the appliance. For example, these attachment holes 50 can support plastic rings, ties, straps, etc.

Variations of passageway enhancers 90 of the second embodiment comprise the stipulated variations of all embodiments for: sternum passageways, tube passageways, breast passageways, breast tissue exposure holes, bands, attachment holes, entry lips, textures, recesses, grooves, stabilizers, attachment rings (described in detail in the third embodiment) and attachment tabs. Variations of passageway enhancers of the second embodiment further comprise: passageway enhancers designed to attach to all embodiments at any location on the sexual aid appliance; passageway enhancers designed to attach to a bra or a ladies breast covering garment; passageway enhancers that serve to create or enhance features comprising: sternum passageways, tube passageways, breast passageways, breast tissue exposure holes, bands, attachment holes, entry lips, textures, recesses, grooves, stabilizer, attachment rings, attachment tabs and attachment means; and passageway enhancers with any means of attachment to the sexual aid appliance comprising: magnets, friction hold, adhesives, arms that clip into, pressure fit, etc. There can be none, one or a plurality of passageway enhancers designed for use as a standalone appliance or with any receptive sexual aid appliance.

Material—Second Embodiment

The preferred material for the second embodiment of the sexual aid appliance as illustrated in FIGS. 12-31 is the same as the preferred material for the first embodiment, with an additional material required for any stabilizer 85 if any stabilizer 85 is present. The stabilizer 85 material is the same as the stabilizer 85 material described in the first embodiment.

Manufacturing—Second Embodiment

The second embodiment of the sexual aid appliance made with a single material (no stabilizer 85 present) can be manufactured using the same techniques and technologies as stipulated for the first embodiment of the sexual aid appliance with no stabilizer 85.

The stabilizer 85 can be manufactured using the same techniques and technologies as stipulated for the stabilizer 85 for the first embodiment of the sexual aid appliance.

The second embodiment of the sexual aid appliance with stabilizer 85 can be manufactured using the same techniques and technologies as stipulated for the first embodiment of the sexual aid appliance with stabilizer 85.

Operation—FIGS. 12-31—Second Embodiment

The second embodiment as illustrated in FIGS. 12-24 of the sexual aid appliance is secured in place by fitting the appliance under a ladies' common garment for covering breasts such that the sternum passageway 5 is positioned to fit in between the breasts 200 in general alignment with the sternum of the wearer. Alternatively, the sexual aid appliance can be held in place with a hand, hands or straps can be threaded through the attachment holes 50 within the attachment tabs 115. The straps used to secure the appliance in place can have many configurations (not to be limited to any configuration) as long as the final configuration is such that the sternum passageway 5 is positioned to fit in between the breasts 200 and in general alignment with the sternum. In this position, the sternum passageway 5 has a passageway for an artificial or real penis to move between the breasts 200 of the wearer. If a passageway enhancer 90 is desired or required, as illustrated in FIGS. 25-31, it is preferably assembled to the sexual aid appliance prior to fitting the appliance in place.

Next, a lubricant is applied to the area of the sexual aid appliance and to the skin of the wearer where an artificial or a real penis will be moving. The artificial or a real penis can then be inserted into the lubricated area to massage the breast tissue or massage the area in between the breasts. Optionally, none, one or a plurality of stimulation devices such as, but not limited to, a vibrating bullet, heating device or motorized massaging device can be inserted into any orifice of the appliance or inserted anywhere under the appliance or placed anywhere on top of the appliance.

After use, the sexual aid appliance can be removed, disassembled if required, cleaned and reused.

FIGS. 32-48—Third Embodiment

Figure 33:
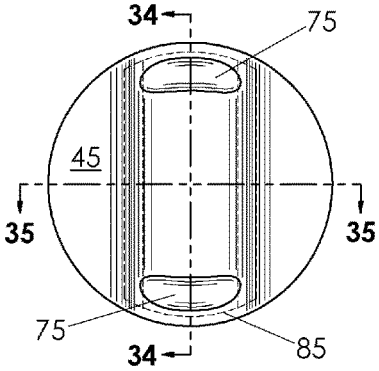
FIG. 33 is a top view of the appliance of FIG. 32.
Figure 34:
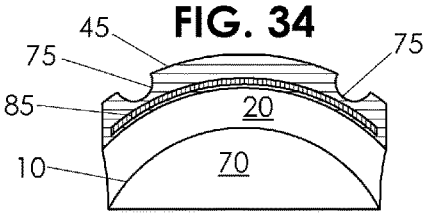
FIG. 34 is a cross-sectional view taken along 34-34 of the appliance of FIG. 33.
Figure 35:
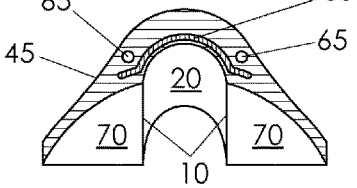
FIG. 35 is a cross-sectional view taken along 35-35 of the appliance of FIG. 33.

The third embodiment of the sexual aid appliance illustrated in FIGS. 32-48 features variations of the following components comprising: breast passageways 20, recesses 65, stabilizers 85, grooves 75, attachment tabs 115, attachment holes 50, breast tissue exposure holes 25, attachment rings 110, breast contact areas 70, entry lips 55 and means of attachment. The third embodiment is shaped like a bowl with a passageway on the inner surface 40. The bowl has an outer surface 45. The appliance is circular in the top view as illustrated in FIG. 33. The appliance is sized and shaped to cover a portion of a breast with enough area to allow an artificial or real penis to penetrate the appliance to induce a massage to the breast tissue that is exposed to the appliance.

Variations of the third embodiment of the sexual aid appliance can comprise: top view shape variations comprising: circular, triangular, oval, octagonal, polygonal, irregular shapes, and any shape that serves to provide structure for at least one passageway.

Breast Passageways 20—The breast passageway 20 of the third embodiment as illustrated in FIGS. 32-42 has similar features, structure and characteristics as the breast passageway 20 of the first embodiment. The breast passageway 20 of the third embodiment is a concave semi-circular cross-sectional passageway on the inner surface 40 of the bowl-shaped appliance. When the appliance is positioned on a breast, the breast passageway 20 is sized and shaped to be a passageway over the breast of the wearer for an artificial or real penis to massage breast tissue.

Figure 36:
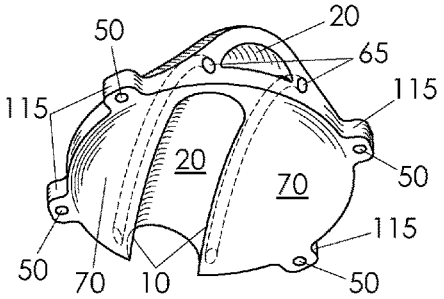
FIG. 36 is a perspective view of a variation of the sexual aid appliance of FIG. 32 with attachment tabs, attachment holes, an alternative breast passageway and no stabilizer in accordance with the third embodiment.
Figure 37:
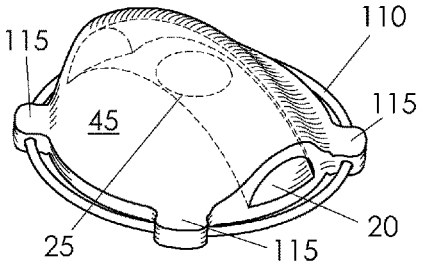
FIG. 37 is a perspective view of a variation of the sexual aid appliance of FIG. 32 with an attachment ring, an alternative breast passageway, a breast tissue exposure hole, no stabilizer and no recesses in accordance with the third embodiment.
Figure 38:
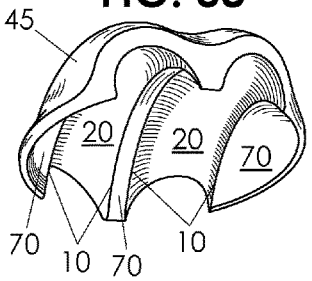
FIG. 38 is a perspective view of a variation of the sexual aid appliance of FIG. 32 with alternative breast passageways, no stabilizer and no recesses in accordance with the third embodiment.
Figure 39:
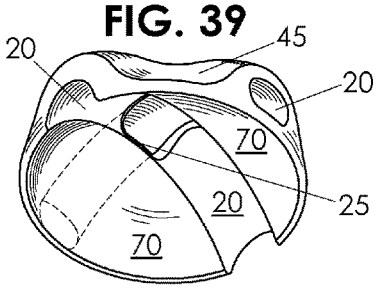
FIG. 39 is a perspective view of a variation of the sexual aid appliance of FIG. 32 with a breast tissue exposure hole, alternative breast passageways, no stabilizer and no recesses in accordance with the third embodiment.
Figure 40:
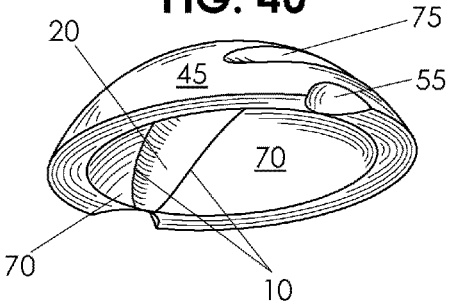
FIG. 40 is a perspective view of a variation of the sexual aid appliance of FIG. 32 with alternative breast passageways, with grooves, with entry lips and no recesses and no stabilizer in accordance with the third embodiment.

Alternatively, a portion of the breast passageway 20 has a connected bridge of material from one passageway edge 10 to the opposite passageway edge 10 as illustrated in FIGS. 36-37. Alternatively, there can be two parallel breast passageways 20 as illustrated in FIG. 38, having no bridge of material between the passageway edges 10. Alternatively, there can be breast passageways 20 perpendicular to each other as illustrated in FIG. 39. In this illustration, one breast passageway 20 has no bridge of material between the passageway edges 10 and the other breast passageway 20 has a portion of material bridged between the passageway edges 10. Alternatively, the breast passageway 20 illustrated in FIGS. 40-42, when placed in position on a wearer does not have a visible breast passageway 20. There is an entry lip 55 to indicate the location of the breast passageway 20 on the inner surface 40 of the appliance. When an entry lip 55 is penetrated, the elastic material naturally deforms and the artificial or real penis is exposed to the breast passageway 20. Alternatively, an ultra-flexible material 120 can be utilized to create the breast passageway 20 illustrated in FIGS. 43-48. When the appliance with the ultra-flexible material 120 is in place on a wearer, the appliance does not have a visible breast passageway 20. The appliance has entry lips 55 to indicate the location of the ultra-flexible material 120 within the appliance. When an entry lip 55 is penetrated, the ultra-flexible material 120 naturally deforms to create a breast passageway 20 for the artificial or real penis.

Variations of breast passageways 20 of the third embodiment comprise the same variations for breast passageways as stipulated in the first embodiment.

Recesses 65—The recesses 65 of the third embodiment as illustrated in FIGS. 32-36 have similar features, structure and characteristics as the recesses 65 of the first embodiment. Each recess 65 of the third embodiment as illustrated in FIGS. 32-36 is adjacent to, parallel, and on either side of the breast passageway 20. As in previous embodiments, the recesses 65 are designed to hold none, one or a plurality of stimulation devices.

Alternatively, the third embodiment can have no recesses 65 as illustrated in FIGS. 37-48.

Variations of recesses 65 of the third embodiment comprise the same variations for recesses as stipulated in the first embodiment.

Stabilizers 85—The stabilizer 85 of the third embodiment as illustrated in FIGS. 32-35 has similar features, structure and characteristics as the stabilizers 85 of the first embodiment. The third embodiment of the sexual aid appliance has one embedded stabilizer 85 as illustrated in FIGS. 32-35. The stabilizer 85 follows the contours of the breast passageway 20 and partly extends outward along the contours of the appliance adjacent to the breast contact areas 70. This partial extension of the stabilizer 85 onto the contours of the breast contact areas 70 serves to distribute pressure. The stabilizer 85 is a more rigid material designed to resist the collapsing of the breast passageway 20 when the appliance is positioned and secured in place.

Alternatively, the third embodiment can have no stabilizer 85 as illustrated in FIGS. 37-48.

Variations of stabilizers 85 of the third embodiment comprise the same variations for stabilizers as stipulated in the first embodiment.

Grooves 75—The grooves 75 of the third embodiment as illustrated in FIGS. 32-35, 40-42 have similar features, structure and characteristics as the grooves 75 of the first embodiment. The third embodiment of the sexual aid appliance has two grooves 75 as illustrated in FIGS. 32-35, 40-42. These grooves 75 are kidney-shaped depressions on the outer surface 45 of the appliance, located near the edge of the appliance.

Alternatively, the third embodiment can have no grooves 75 as illustrated in FIGS. 36-39, 43-48.

Variations of grooves 75 of the third embodiment comprise the same variations for grooves as stipulated in the first embodiment.

Attachment Tabs 115/Attachment Holes 50—The four attachment tabs 115 and four attachment holes 50 of the third embodiment as illustrated in FIG. 36 have similar features, structure and characteristics as the attachment tabs 115 and the attachment holes 50 in the second embodiment.

Alternatively, the third embodiment can have no attachment tabs 115 and/or no attachment holes 50 as illustrated in FIGS. 32-35, 38-48. Alternatively, there can be attachment tabs 115 with no attachment holes 50 as illustrated in FIG. 37. This illustration has an integrated attachment ring 110 molded into the appliance that serves as an alternative attachment means to position and secure the appliance around the wearer's body parts comprising: torso, limbs, and neck. Due to the elastic nature of the material the attachment ring 110 sections can be stretched like an elastic band for securing the appliance in position on the wearer.

Variations of the attachment holes 50 of the third embodiment comprise the same variations for the attachment holes as stipulated in the second embodiment. Variations of the attachment tabs 115 of the third embodiment comprise the same variations for the attachment tabs as stipulated in the second embodiment.

Figure 41:
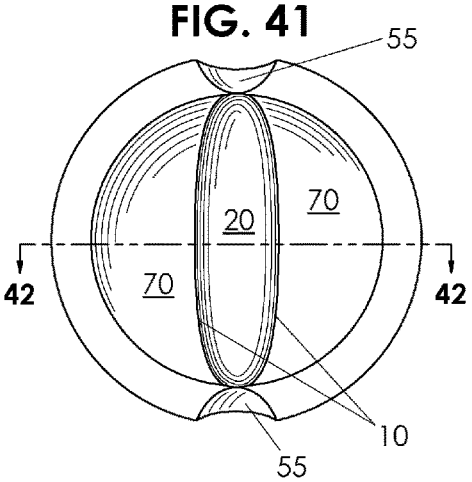
FIG. 41 is top view of the appliance of FIG. 40.
Figure 42:
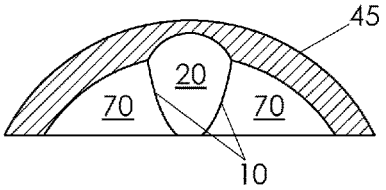
FIG. 42 is a cross-sectional view taken along 42-42 of the appliance of FIG. 41.
Figure 43:
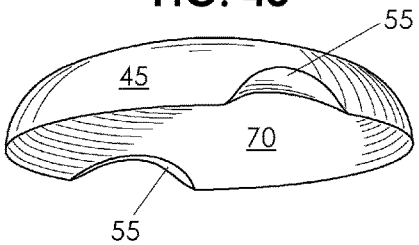
FIG. 43 is a perspective view of a variation of the sexual aid appliance of FIG. 32 with an alternative breast passageway made of ultra-flexible material, with entry lips, no stabilizer and no recesses in accordance with the third embodiment.
Figure 46:
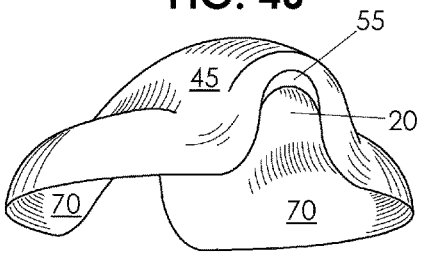
FIG. 46 is a perspective view of the appliance of FIG. 43 with the breast passageway in stretched form.
Figure 44:
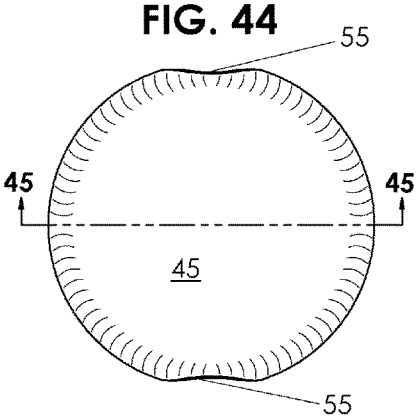
FIG. 44 is a top view of the appliance of FIG. 43.
Figure 47:
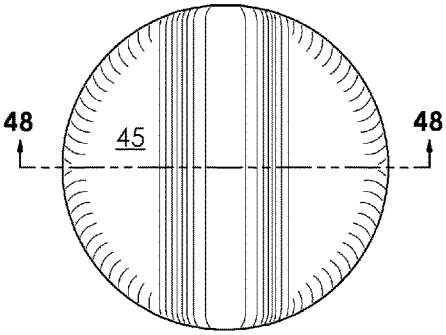
FIG. 47 is a top view of the appliance of FIG. 46.
Figure 45:
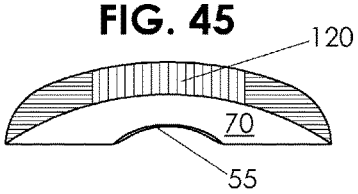
FIG. 45 is a cross-sectional view taken along 45-45 of the appliance of FIG. 44.
Figure 48:
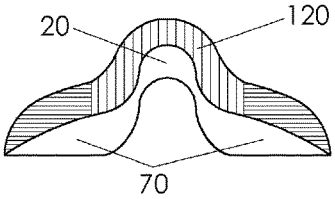
FIG. 48 is a cross-sectional view taken along 48-48 of the appliance of FIG. 47.

Entry Lips 55—The third embodiment of the sexual aid appliance has two chamfered entry lips 55 on the appliance edge as illustrated in FIGS. 40-48. These entry lips 55 are beveled portions on the appliance edge which serve to indicate where the breast passageway 20 of the appliance starts and ends. The entry lips 55 also serve to facilitate access to the breast passageway 20 for an artificial or real penis. The chamfered entry lips 55 are found on opposite sides of the appliance edge as illustrated in FIG. 41.

Variations of the entry lips 55 of the third embodiment comprise: entry lips that are symmetrical or asymmetrical in location on the appliance; entry lips with various cross-sectional shapes comprising: circular, polygonal, octagonal or irregular shapes, and combinations thereof, etc.; entry lips that are at any angle to the appliance edge to facilitate entry into the appliance; various entry and exit lip geometry configurations; entry lips with or without texture; entry lips made with texture; entry lips that are shaped similar to any orifice of the human body; entry lips that connect to other massage elements; and any entry lips that is sized and shaped to allow entry of an artificial or real penis into or under the appliance. There can be none, one, or a plurality of entry lips on any sexual aid appliance.

Material—Third Embodiment

The preferred material for the third embodiment of the sexual aid appliance as illustrated in FIGS. 32-48 is the same as the preferred material for the first embodiment, with an additional material required for stabilizers 85 if any stabilizer 85 or stabilizers 85 are present and an additional ultra-flexible material 120 required for an appliance requiring an ultra-flexible material 120. The stabilizer 85 material is the same as the stabilizer 85 material described in the first embodiment.

The ultra-flexible material 120 required for the appliance illustrated in FIGS. 43-48 is a medical-grade silicone, rubber, elastomer or elastomeric gel with a durometer measurement between 0.1-5 on the Shore 00 scale of hardness. The ultra-flexible material 120 is preferably a similar material with similar properties used for the first embodiment, albeit more flexible. The flexibility of the induced breast passageway 20 is dependent upon the thickness of the ultra-flexible material 120 and the durometer of the material used for the ultra-flexible material 120. A thicker cross-section with a lower durometer material can have the same flexibility as a thinner cross-section with a higher durometer material. The induced breast passageway 20 appliance can be made with the same material as the first embodiment without a stabilizer 85 if the thickness of the material in the passageway area is thin enough to emulate the ultra-flexible material 120 properties. Durometers outside of the stated preferred range can be used depending on the shape, geometry and characteristics for the ultra-flexible material 120.

Manufacturing—Third Embodiment

The third embodiment of the sexual aid appliance made with a single material (no stabilizer 85 or no ultra-flexible material 120) can be manufactured using the same techniques and technologies as stipulated for the first embodiment of the sexual aid appliance with no stabilizer 85.

The third embodiment of the sexual aid appliance with stabilizer 85 or the ultra-flexible material 120 can be manufactured using the same techniques and technologies as stipulated for the first embodiment of the sexual aid appliance with stabilizer 85.

The stabilizer 85 or the ultra-flexible material 120 portion of the appliance can be molded with conventional manufacturing methods comprising: conventional injection molding techniques and technologies, extrusion techniques and technologies, gravity-fed molding techniques, poured-molding techniques or any technology that allows for the forming of material into a desired shape.

Alternatively, the third embodiment can be extruded. In this case, the sexual aid appliance would have a constant cross-section instead of having a bowl shape. Fortunately, due to the material's elastic nature, the appliance when placed under a ladies' common garment for covering the breasts, the breast contact areas 70 would naturally conform to the breast. In the case of an extruded appliance, the entrance to each passageway will not be rounded without post-processing of the extrusion. Due to the material's elastic nature, post processing to create a smooth entry lip 55 is difficult as is maintaining consistency and repeatability on each passageway entry and/or edge. Therefore, injection molding is the preferred method for manufacturing the appliance.

Operation—FIGS. 32-48—Third Embodiment

The third embodiment as illustrated in FIGS. 32-48 of the sexual aid appliance, having a bowl shape, is positioned under a ladies' common garment for covering breasts, aligning the edges of the tube top or the brassiere in available grooves 75, if grooves 75 are present on the appliance. Alternatively, the appliance can be held in place with a hand or hands. Alternatively, if the appliance has attachment tabs 115 with attachment holes 50 as illustrated in FIG. 36, the appliance can be secured to the wearer using a plurality of securing means that, if necessary, incorporate attachment tabs 115 and/or attachment holes 50. Alternatively, if the appliance has a built in attachment ring 110 as illustrated in FIG. 37, the sections of the ring can be stretched around the torso, limbs and/or neck to secure the appliance in position on the wearer. The sexual aid appliance is positioned such that the inner surface is placed in contact with the breast, creating a passageway for an artificial or real penis to enter and massage the breast. The appliance can be moved to different regions of the breast to effectively massage any breast tissue.

Next, a lubricant is applied to the area of the sexual aid appliance and to the skin of the wearer where an artificial or a real penis will be moving. The artificial or a real penis can then be inserted into the lubricated area to massage the breast tissue. Optionally, none, one or a plurality of stimulation devices such as, but not limited to, a vibrating bullet, heating device or motorized massaging device can be inserted into any orifice of the appliance or inserted anywhere under the appliance or placed anywhere on top of the appliance.

After use, the sexual aid appliance can be removed, disassembled if required, cleaned and reused.

CONCLUSION, RAMIFICATIONS AND SCOPE

While the above figures contain many specificities, the reader should not construe these as limitations on the scope of the invention, but merely as exemplifications of several preferred embodiments thereof. Various other embodiments are possible. Further embodiments of the sexual aid appliance comprising various configurations of the variations described for each element in the specification are possible. Those element variations include variations of: sternum passageways, tube passageways, breast passageways, breast tissue exposure holes, bands, attachment holes, entry lips, textures, recesses, grooves, stabilizers, passageway enhancers, attachment rings, and attachment tabs. Different flexible and resilient materials can be used for the sexual aid appliance. The sternum passageways, tube passageways, breast passageways, and passageway enhancers, can comprise passageways made of stays, ribs, pillows, bolsters, raised edges, or any shape that would serve as a passageway for a penis. The sexual aid appliance can be used by a single user or by couples. A hand can be introduced into any accommodating passageway or orifice of the appliance to massage. The appliance can have a variety of shapes to cover more area or less area resulting in varying degrees of sensations of pressure on the penis and varying degrees of breast massage sensations on the wearer. The passageways can have different shape geometry to create various sensations of pressure on the penis and various degrees of breast massage sensations. The passageways can have entrances and/or exits covered with a flap. The passageway entrances and exits can be adjacent to skin when in position on the wearer. Pigments, scents, anti-bacterial agents or transdermal medication can be added to the material of the appliance. The appliance can be worn all day and/or all night and/or for an extended period of time. The appliance can be sized and shaped for use on other parts of the body, for example: the buttocks, the legs, the back, or anywhere else on the human body. The whole sexual aid appliance can be designed and constructed to be symmetrical or asymmetrical. The appliance can be integrated into a ladies' bra. The appliance other than the passageways can be made of other materials. Each passageway can be constructed with multiple elastomeric materials. Optionally, tentacle-like protrusions, offering additional stimulation, spanning from the appliance can be added to all embodiments. These tentacle-like protrusions can touch sensitive regions of the breast or other sensitive regions of the body. The reader can see that the sexual aid appliance provides individuals and/or couples with a new, highly effective and economical means to massage breast tissue and the area in between the breasts.

I claim:

1. An intimate massage article, comprising:

a) a main body, configured to be worn on a chest of a human wearer, b) at least one passageway, defined in a portion of the main body, wherein said portion of the main body is made of at least one elastomeric material, the at least one passageway is configured to accommodate a human penis, the at least one passageway is a built-in predetermined trajectory for the human penis, the at least one passageway is configured to prevent lateral movement of the penis, the at least one passageway is an elongated member that is crescent-shaped in nature, the at least one passageway extends beyond an opening coextensive therewith, the main body is configured to guide the penis in the at least one passageway over at least a portion of the chest of the wearer, the main body is configured to allow a skin of the penis inserted in the at least one passageway to make skin-to-skin contact with a skin of the at least a portion of the chest of the wearer, the main body is configured to guide the penis in the at least one passageway without encapsulating the full circumference of the penis, and whereby, the chest of the wearer of the intimate massage article is stimulated when the human penis is inserted in the at least one passageway.

2. The intimate massage article of claim 1, wherein the at least one passageway is selected from the group consisting of at least one sternum passageway, at least one tube passageway, and at least one breast passageway, whereby, the at least one sternum passageway, the at least one tube passageway, and the at least one breast passageway are built-in predetermined trajectories for the human penis.

3. The intimate massage article of claim 2, wherein the main body is embodied by a strip.

4. The intimate massage article of claim 2, wherein the main body is embodied by a core member.

5. The intimate massage article of claim 2, wherein the main body is embodied by a bowl.

6. The intimate massage article of claim 2, further comprising at least one attachment means, wherein the at least one attachment means is configured to affix the main body to the chest of the wearer.

7. The intimate massage article of claim 6, further comprising at least a second attachment means, wherein the at least a second attachment means affixes the intimate massage article to a second sexual aid.

8. The intimate massage article of claim 2, wherein the main body is configured to allow the skin of the penis inserted in the at least one passageway to make skin-to-skin contact with the skin of at least a portion of the breast of the wearer.

9. The intimate massage article of claim 2, further comprising at least one void, wherein the at least one void is configured to contain at least one auxiliary skin stimulation device.

10. The intimate massage article of claim 2, further comprising at least one stabilizer, wherein the at least one stabilizer comprises an area of more rigid material and wherein the at least one stabilizer serves to restrict deformation of the main body.

11. A method of massaging a chest of a wearer, comprising:

a. providing a sexual aid appliance comprising a main body, configured to be worn on a chest of a human wearer, at least one passageway, defined in a portion of the main body, wherein said portion of the main body is made of at least one elastomeric material, the at least one passageway is configured to accommodate a human penis, the at least one passageway is a built-in predetermined trajectory for the human penis, the at least one passageway is configured to prevent lateral movement of the penis, the at least one passageway is an elongated member that is crescent-shaped in nature, the at least one passageway extends beyond an opening, the main body is configured to guide the penis in the at least one passageway over at least a portion of the chest of the wearer, the main body is configured to allow a skin of the penis inserted in the at least one passageway to make skin-to-skin contact with a skin of the at least a portion of the chest of the wearer, the main body is configured to guide the penis in the at least one passageway without encapsulating the full circumference of the penis, wherein the at least one passageway of the sexual aid appliance comprises at least one hole, wherein the at least one hole exposes skin of a breast of the human wearer to the human penis when the human penis is in the at least one passageway, b. positioning the sexual aid appliance onto the chest of the human wearer, c. applying lubricant to an area that the human penis will be moving over, d. inserting the human penis into the at least one passageway, and e. massaging the chest of the human wearer as a result of a movement of the human penis in the at least one passageway.

12. The method of claim 11, wherein the at least one passageway of the sexual aid appliance is selected from the group consisting of at least one sternum passageway, at least one tube passageway, and at least one breast passageway, whereby, the at least one sternum passageway , the at least one tube passageway, and the at least one breast passageway are built-in predetermined trajectories for the human penis.

13. The method of claim 12, wherein the main body is embodied by a strip.

14. The method of claim 12, wherein the main body is embodied by a core member.

15. The method of claim 12, wherein the main body is embodied by a bowl.

16. The method of claim 12, further attaching the main body in place on the chest of the wearer with an attachment means.

17. The method of claim 12, further attaching a second main body to the sexual aid appliance to modulate the at least one passageway.

18. The method of claim 12, wherein the main body further comprises at least one void configured to contain at least one auxiliary skin stimulation device.

19. The method of claim 12, wherein the main body further comprises at least one stabilizer, wherein the at least one stabilizer comprises an area of more rigid material of the sexual aid appliance and wherein the at least one stabilizer serves to restrict deformation of the sexual aid appliance.

* * * * *